US012611589B2

(12) United States Patent
Olsen

(10) Patent No.: US 12,611,589 B2
(45) Date of Patent: Apr. 28, 2026

(54) WORD GAME AND METHOD OF PLAY

(71) Applicant: USAOPOLY, LLC, Carlsbad, CA (US)

(72) Inventor: Eric Olsen, Boise, ID (US)

(73) Assignee: USAOPOLY, LLC, Carlsbad, CA (US)

( * ) Notice: Subject to any disclaimer, the term of this patent is extended or adjusted under 35 U.S.C. 154(b) by 1052 days.

(21) Appl. No.: 17/699,795

(22) Filed: Mar. 21, 2022

(65) Prior Publication Data

US 2022/0305368 A1 Sep. 29, 2022

Related U.S. Application Data

(60) Provisional application No. 63/164,666, filed on Mar. 23, 2021.

(51) Int. Cl.
*A63F 1/04* (2006.01)
*A63F 1/00* (2006.01)

(52) U.S. Cl.
CPC ..... *A63F 1/04* (2013.01); *A63F 2001/008* (2013.01); *A63F 2001/0458* (2013.01); *A63F 2001/0475* (2013.01); *A63F 2250/1063* (2013.01)

(58) Field of Classification Search
CPC ..... A63F 1/04; A63F 2001/0458; A63F 2001/008; A63F 2001/0475; A63F 9/0073; A63F 2009/186
USPC ..... 273/272, 276, 299
See application file for complete search history.

(56) References Cited

U.S. PATENT DOCUMENTS 4,927,147 A * 5/1990 Delzio ..... A63F 1/04 273/304
5,297,801 A * 3/1994 Croker ..... A63F 3/0423 434/167
7,887,058 B2 * 2/2011 Ritter ..... A63F 9/183 463/9
8,376,363 B1 * 2/2013 Lizotte ..... A63F 3/00006 273/287
10,195,517 B2 * 2/2019 Fechser ..... A63F 3/0423
2005/0082763 A1 * 4/2005 DeGennaro, Jr. ..... A63F 9/18 273/430
2006/0220316 A1 * 10/2006 Clayton ..... A63F 3/00006 273/248
2006/0261554 A1 * 11/2006 Hamner ..... A63F 3/0423 273/272
2007/0052166 A1 * 3/2007 Hyry ..... A63F 9/00 273/459
2010/0052257 A1 * 3/2010 Osborne ..... A63F 9/18 273/429
2011/0309575 A1 * 12/2011 Ribeiro ..... A63F 9/18 273/138.1
2012/0129599 A1 * 5/2012 McGovern ..... A63F 3/00643 273/287
2014/0265119 A1 * 9/2014 Bazarko ..... A63F 9/18 273/240

(Continued)

*Primary Examiner* — Joseph B Baldori
(74) *Attorney, Agent, or Firm* — CANTOR COLBURN LLP

(57) ABSTRACT

A word-guessing game and a method of playing are provided. The word-guessing game having a word card having one or more words shown on the word card. One or more pieces are provided for playing the word-guessing game. Each of the one or more pieces are physical objects, and wherein the one or more pieces are configured to be arranged by a player on a playing surface to make a visual representation of a word of the one or more words shown on the word card.

15 Claims, 6 Drawing Sheets

(56) References Cited

U.S. PATENT DOCUMENTS

2016/0074748 A1* 3/2016 Bullock ..... A63F 3/00097
273/272
2016/0332069 A1* 11/2016 Ross ..... A63F 9/18

* cited by examiner

TEACHER

AIRCRAFT CARRIER

IGLOO

KING ARTHUR

WRESTLE

COMPARING APPLES AND ORANGES

FIG. 2

WORD GAME AND METHOD OF PLAY

CROSS-REFERENCE TO RELATED APPLICATIONS

This application claims the benefit of U.S. Provisional Patent Application No. 63/164,666 filed Mar. 23, 2021, the disclosure of which is incorporated herein by reference in its entirety.

FIELD OF THE INVENTION

The present disclosure falls under the broad category of tabletop games, and more particularly, under the category of word-guessing games.

BACKGROUND

Tabletop games include board games, card games, tile games and dice games. Many popular tabletop games revolve around words. For example, one broad category of word games is word-building games. Popular word-building games include Scrabble, Boggle and Bananagrams. Another broad category is word-guessing games. Popular word-guessing games include Taboo, Pictionary, and Charades. In a typical word-guessing game, players give clues to get other players to guess a particular word.

There are multiple ways for a player to provide clues including verbally giving a clue, drawing a clue and acting out a clue. Taboo is an example of a game where clues are given verbally. Pictionary is an example of a game where clues are drawn. In Charades, clues are acted out. In addition to how clues are given, there are many other aspects of gameplay that combine in different ways to make each game unique. Some aspects of gameplay that show up in many word-guessing games are how many words need to be guessed, time limits, individual or team play and physical components such as buzzers, boards and timers.

People of all ages love to make things with their hands. Surprisingly, there are few word-guessing games in which gaming pieces are used to build a clue. Therefore, there is a golden opportunity to combine people's love of making things with their hands with people's love of word-guessing games.

SUMMARY

Disclosed herein is a tabletop game and method of play in which players arrange a variety of gaming pieces of different shapes and sizes to create designs that represent a word or phrase, and other players try to guess the word or phrase.

BRIEF DESCRIPTION OF THE DRAWINGS

Some embodiments of the present invention are illustrated as examples and are not limited in any way by the figures of the accompanying drawings.

FIG. 2 is a picture of a word card

DETAILED DESCRIPTION OF THE INVENTION

Disclosed herein is a word-guessing game and method of play. The present disclosure is to be considered as an exemplification of the invention, and is not intended to limit the invention to specific embodiments illustrated by the examples and descriptions that follow. The game consists of a set of pieces in a variety of shapes and sizes, and a set of word cards. In general, players arrange the pieces on a flat playing surface to create visual representations of the words on the cards. In addition, after a piece has been placed on the playing surface, a player may manually slide that piece around the playing surface to simulate movement. See [0024] for a detailed explanation of simulated movement.

Figure 5:
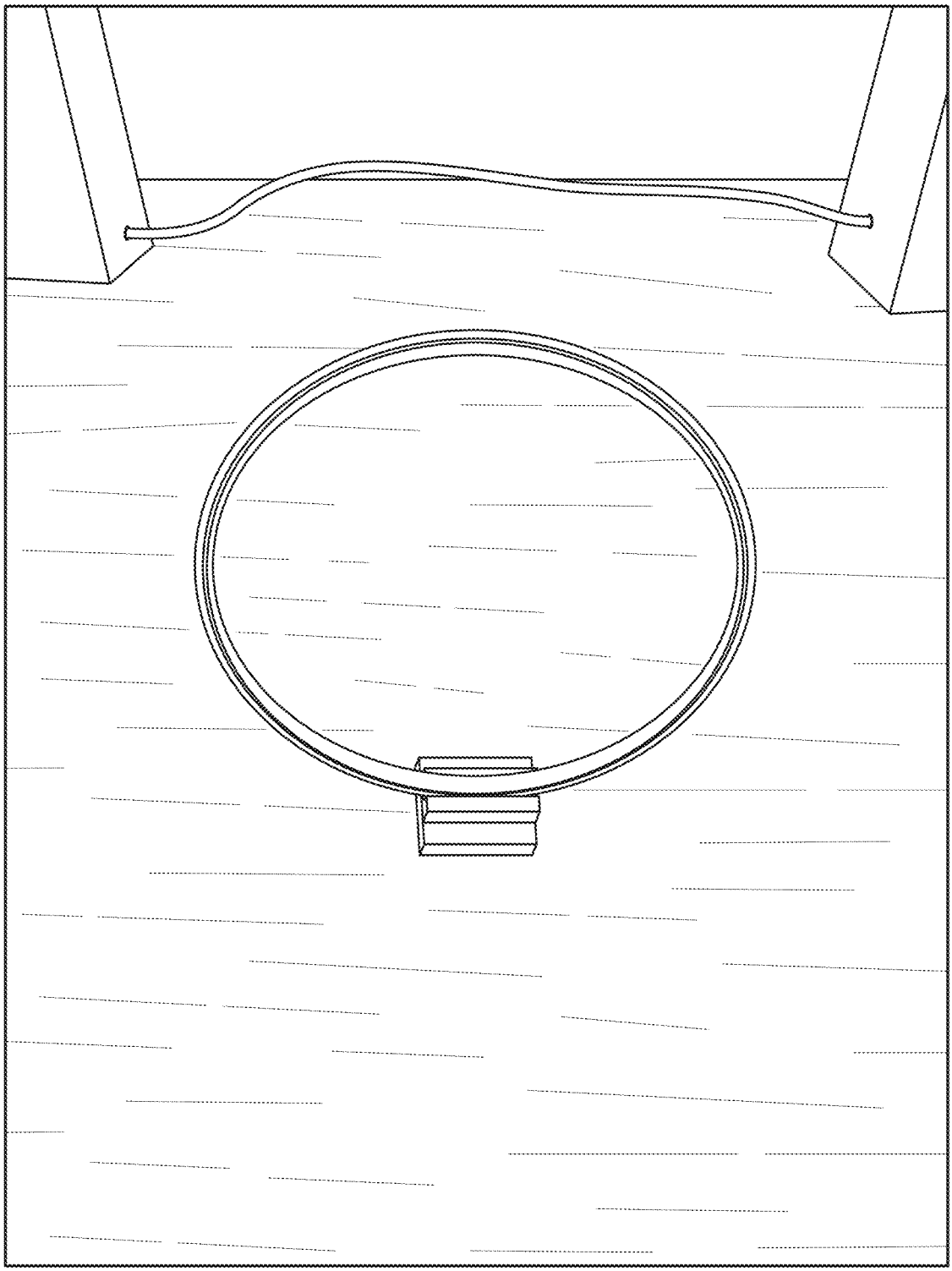
FIG. 5 is a picture of a stand for the pieces

The pieces consist primarily of basic shapes which include: 1) 2-dimensional geometric figures such as triangles and circles, 2) 3-dimensional geometric figures such as spheres and cubes, 3) shapes that occur in nature such as plants and animals, 4) shapes that appear on a keyboard such as numbers and arrows and 5) other basic shapes such as wavy lines and stick figures. The pieces include certain pieces which are stands or support pieces for other pieces, as illustrated in FIG. 5. Players use the stand piece or pieces to change the plane in which a piece or more than one piece is placed during game play. The pieces may be produced out of any suitable material or materials, including plastics, metals, or wood. The pieces are lightweight and easy for players to manipulate. Ideally, the pieces are slightly flexible making them safer and more durable.

Figure 1A:
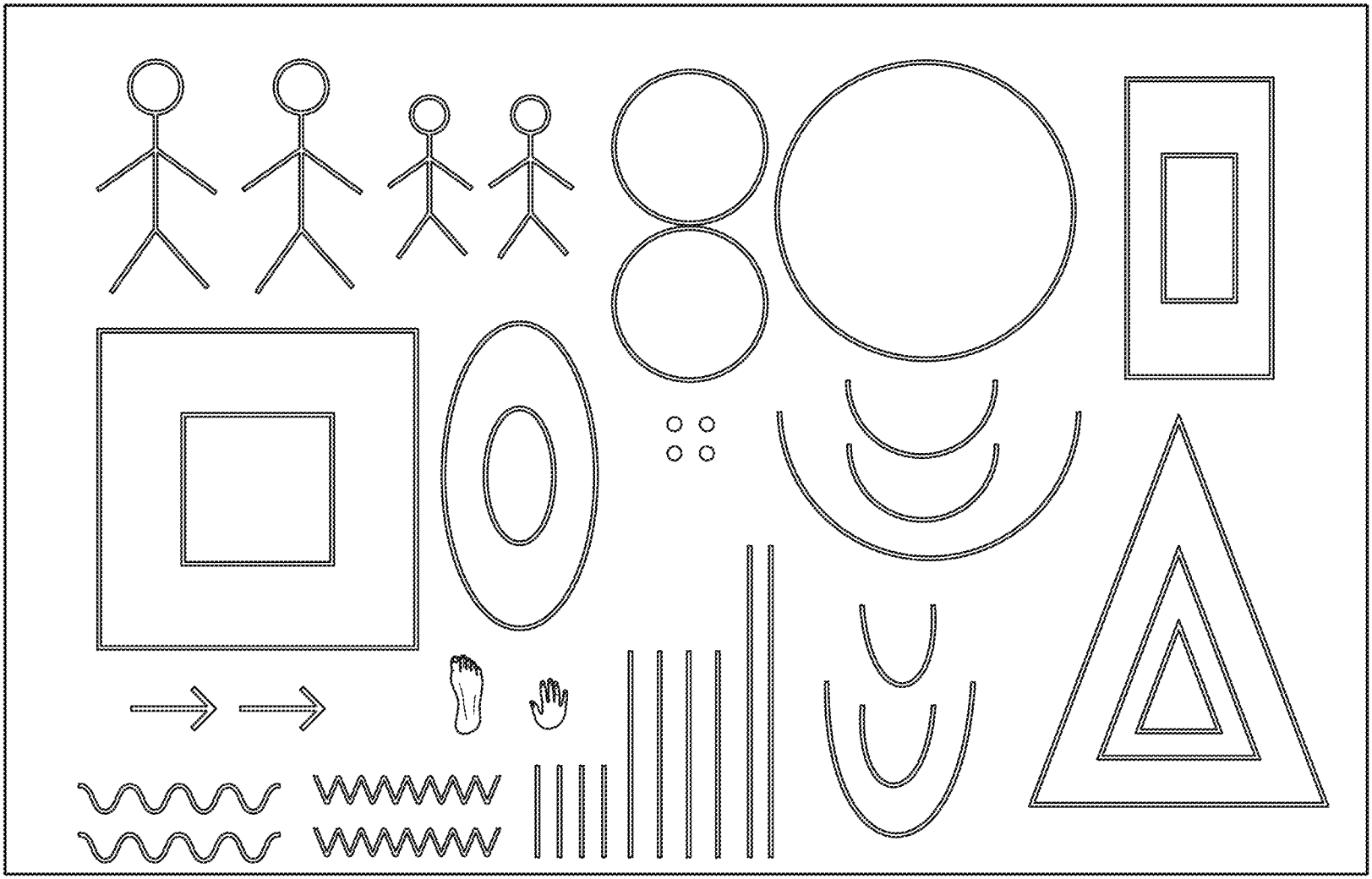
FIG. 1*a*-1*b* are pictures of sets of gaming pieces

In one exemplary embodiment, the game consists of a set of 44 gaming pieces as depicted in FIG. 1*a*. The pieces are approximately 3 mm in height. The shapes and dimensions of each piece are detailed below. All dimensions are in millimeters. The number in parenthesis indicates how many of that piece are included in the set. The shapes and dimensions of each piece detailed below are exemplary and the examples are not to limit the scope of the invention. The sets of game pieces may include any number of pieces and any number of sets.

Square
- 100×100 (1)
- 50×50 (1)

Circle
- 100 diameter (1)
- 50 diameter (2)
- 7 dots (4)

Stick
- 100 (2)
- 62.5 (4)
- 25 (4)

Rectangle
- 100×33 (1)
- 50×25 (1)

Triangle
- 100×120 (1)
- 50×60 (1)
- 25×30 base (1)

Oval
- 100×50 (1)
- 50×25 (1)

.C (Half Circle)
- 100 diameter (1)
- 50 diameter (2)

U (Half Oval Long Axis)
- 100 (1)
- 50 (2)

Other
- S squiggle 50 (2)
- V squiggle 60 (2)
- Big Stick Person 70 (2)
- Little Stick Person 45 (2)

Hand 15(1)
Foot 25 (1)
Arrow 25 (2)

Figure 1B:
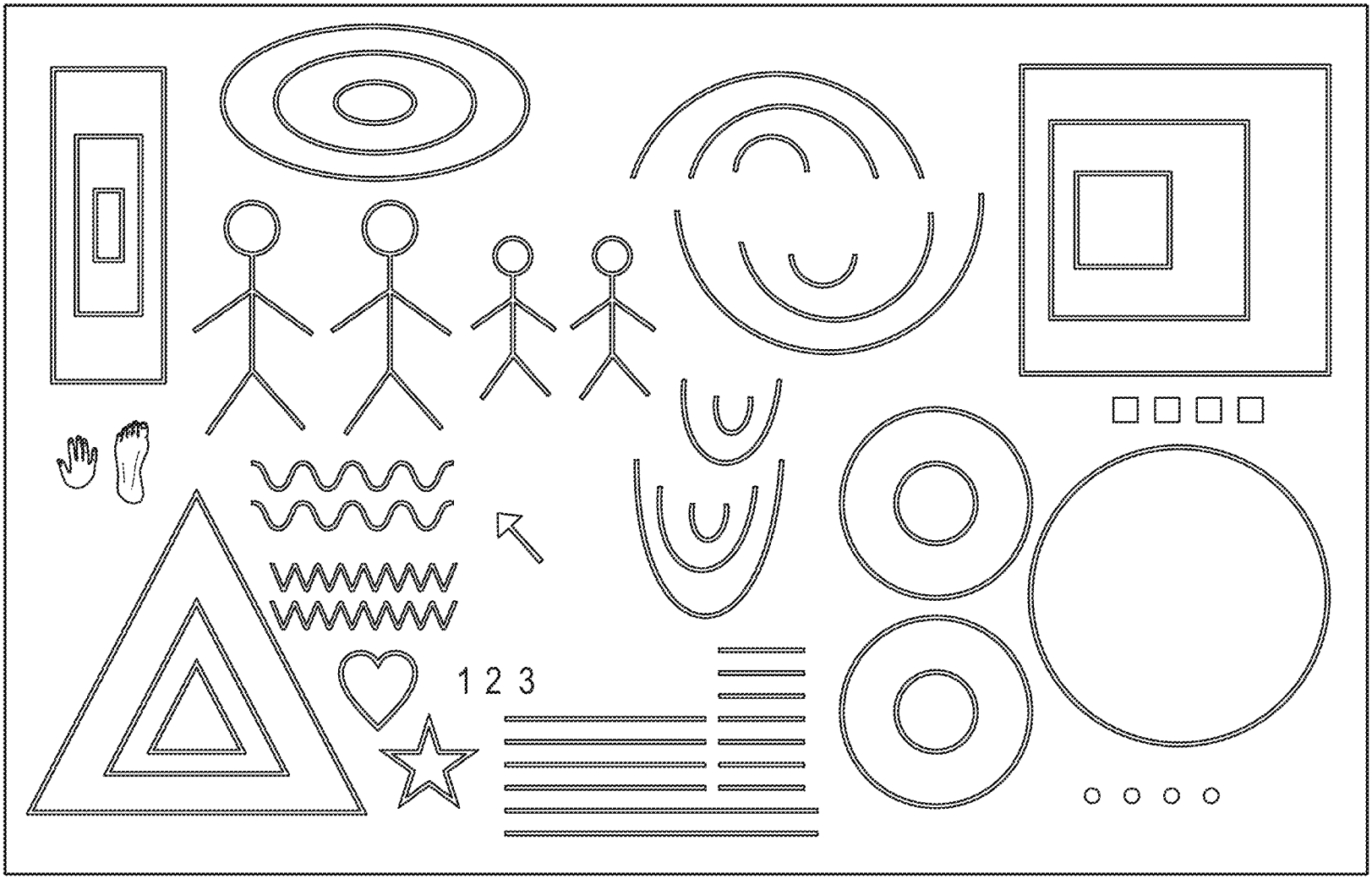

FIG. 1*b* depicts another exemplary set of gaming pieces. This exemplary set includes 63 pieces and includes some pieces that are different in shape and size from the set described in [0014]. A complete set of pieces is designed to maximize enjoyment of the game by balancing the number and shape of the pieces with the difficulty in making the words. If there are too few playing pieces, players may become frustrated because they lack enough pieces to create representations of the words. On the other hand, if there are too many playing pieces, it takes too long to search through the pile to find the desired piece and it also becomes too easy to find the perfect piece to make the word. Part of the enjoyment stems from having to make-do with pieces that work, but are not quite perfect, resulting in amusing representations. For this reason, there are endless possibilities for complete sets that vary slightly from each other.

In an exemplary embodiment, two sets of pieces may be included in each game. The two sets may be identical except they may be different colors. This will allow for team competition and allow for easily keeping track of all the pieces in each set.

In an exemplary embodiment, there is a word card deck of 200 word cards, for example. The word cards have one or more words printed on them. In an exemplary embodiment, a word card has six words. FIG. 2 is an exemplary example of a word card. As used herein and throughout, a "word" shall include the concept of more than one word, such as a short phrase. These 200 cards form the base deck of cards. It should be understood clearly that the present detailed disclosure in no way limits the present invention to a base deck of 200 cards. A reasonable range for the number of cards in the base deck is anywhere between 100 to 500.

In another exemplary embodiment, there is a deck of cards based on a theme such as nature or famous people. In general, in a theme deck, all the words on the cards belong to a particular theme. One theme deck is a junior theme deck. All the words on the cards in the junior theme deck will be suitable for younger players.

In another exemplary embodiment, there is an expert theme deck. All the words on the cards in the expert theme deck will be generally more difficult than those in the base deck and may include adjectives, adverbs and other parts of speech not represented in the base deck.

In another exemplary embodiment there is a sports theme deck. All the words on the cards in the sports theme deck will be related to sports including names of sports, names of players and types of equipment.

In another exemplary embodiment there is a Hollywood theme deck. All the words on the cards in the Hollywood theme deck will be related to Hollywood including names of movies, names of actors, and names of directors.

In another exemplary embodiment there is an adults theme deck. All the words on the cards in the adults theme deck may contain words suitable only for adult players.

Figure 3:
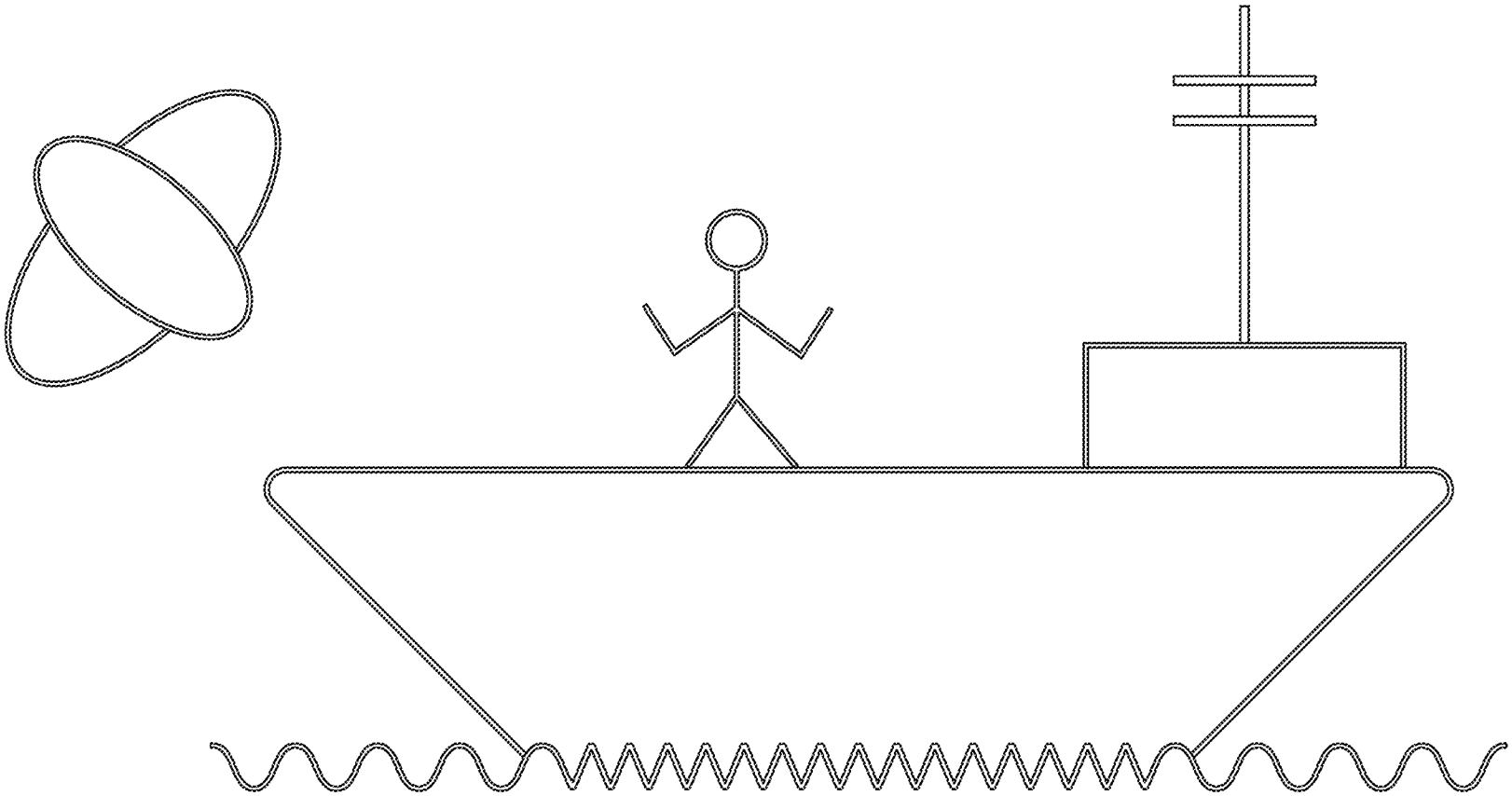
FIG. 3 is a picture of pieces being used to depict a word

In an exemplary method of play, the game begins by laying out a complete set of pieces [0014] on a flat playing surface such as a table or floor. Each player is given a word card [0017] from the word card deck. A player is chosen to be the first builder by a method predetermined by the players. As used herein and throughout, "builder" refers to the player that uses the pieces to make a visual representation of one of the words on the word card. The visual representation cannot spell out the word from the word card using the pieces to make letters. Also, as used herein and throughout, the verb "build", in all its conjugations, refers to the act of a player using the pieces to make a visual representation of one of the words on a word card. The builder may choose to organize the pieces on the table in order for them to be easier to use. The builder then chooses one of the six words on the card. As an example, a player has the card pictured in FIG. 2 and chooses the word "aircraft carrier". The builder may choose any of the six words and does not need to follow a particular order. A timer may be used to provide a time limit (e.g., time period) for the player to make the visual representation of one of the words on the word card and for a fellow player to guess the word. The timer is set for one minute, for example. The timer may be an hourglass, a stopwatch, an egg timer, electronic timing device, or any other timing device known to one of skill in the art. Players may also utilize any timing device they have available, such as, for example, a wall clock, wristwatch, or a smart phone. The timer is started when the builder begins to build the word. As soon as the builder begins to build, the other players try to guess the clue. The builder uses any of the pieces to create a visual representation of the word. FIG. 3 shows an example of how a builder could use gaming pieces to create a visual representation of the word "aircraft carrier". The first player to correctly guess the word earns a point. At the end of one minute, play rotates to the next player, even if no player guesses the word. The next player becomes the builder, and chooses a word from his/her card. Play continues in this manner until each player has been the builder one time. A round is when each player has been the builder one time. The game ends after five rounds. The winner is the player who has the most points at the end of five rounds. Since the game consists of five rounds, there will be one word on the card that was not built. This is on purpose. This gives every player a pass. There might be a word a player is unfamiliar with or a word the player thinks is particularly hard and the player may skip that word.

Figure 4A:
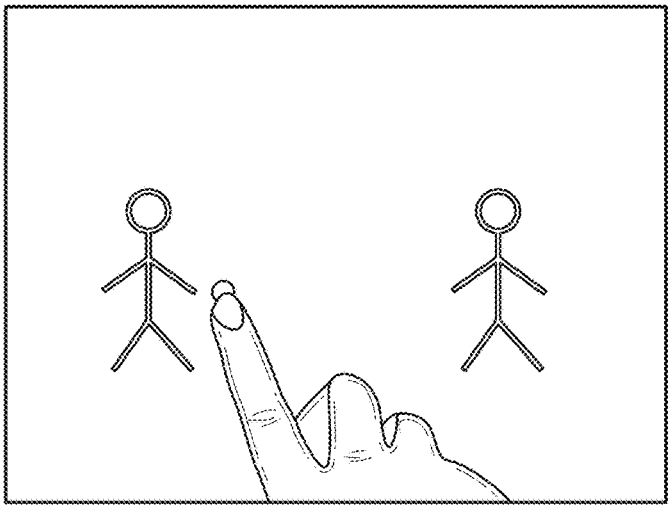
FIG. 4*a*-4*c* are pictures of a pieces being used to depict an action word
Figure 4B:
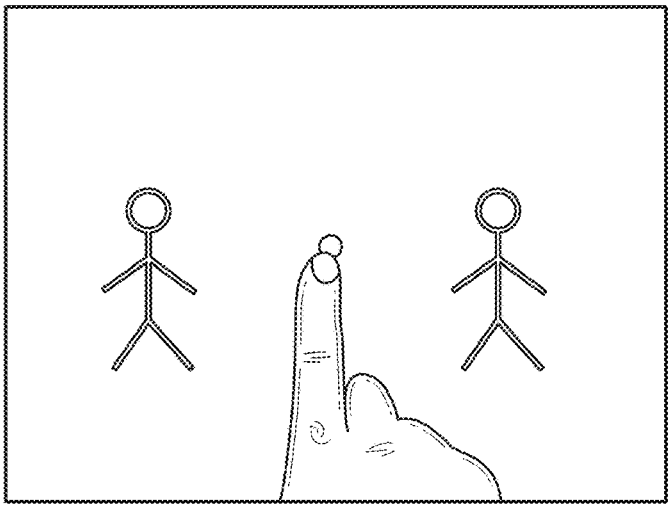
Figure 4C:
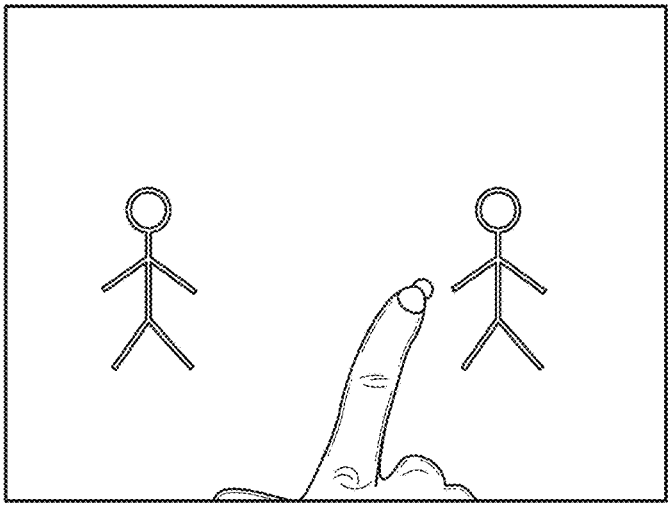

One creative and unique feature of the game is that the builder may move pieces on the table to create action and/or animate the visual representation of the word. In FIGS. 4*a*-4*c*, a builder is building the word, "throw". The builder uses two stick people and a dot representing an object. The builder uses his/her finger to move the dot from one stick person to the other indicating the action of throwing.

The builder is not allowed to speak or make sounds while they are building. The builder cannot use pieces to spell out words. That is contrary to the spirit and intent of the game. The builder cannot use pieces as blanks for words or letters. The builder cannot act out any part of the word.

In another exemplary method of play, the game is scored according to how long it takes the players to guess the word. This embodiment adds an element of tension that many players enjoy. Play proceeds as described in [0023] except for the following scoring changes. If the word is guessed within the first 30 seconds, the builder also earns a point. If the word is not guessed after two minutes, the builder loses a point. If the word is guessed between the 30 seconds and two minutes, the builder does not gain or lose a point.

In another exemplary method of play, the game is played in teams. Instead of each player receiving one card, cards are placed face down in a stack on the playing surface according to the total number of players (players from both teams combined). The recommended number of cards is given below:

4 or 5 players—10 cards
6 or 7 players—15 cards
8 or 9 players—20 cards
10 or 11 players—25 cards One player from each team goes first. After that, the same person cannot go again until everyone on the team has had a turn. The two players take the top card from the pile, look at it together, and decide which word they are going to build. After deciding on a word, the two players begin building at the same time. Each player builds for their own team. The first team to correctly guess the word earns a point for their team. There is a two-minute time limit on building. If no one guesses the word in two minutes, that turn ends and the next two players take their turn. The winning team is the one with the most points after playing all the cards in the stack.

In another exemplary method of play, two teams play as described in [0027], however, the two builders are limited to one set of pieces. The builders do not each get their own set of pieces. This adds a completely new element to the game. Players need to quickly try and acquire the pieces they need because the opposing player may take a piece making it unavailable. It is a race to see which builder gets the pieces they need first.

In another exemplary method of play, the builder can tell the guessers what category of word they are building. This makes the game easier for less experienced players and younger players. For example, a builder could say, "I am building an action" or "I am building a noun". A builder might even be more specific and say, "I am building a person", if the players decide on that before play begins.

In another exemplary method of play, instead of getting one card and building five words on that card as described in [0023], the builder chooses a new card every time they take a turn and chooses one word from that card. This allows maximum flexibility in terms of choosing what word to build. For example, players may decide they want to play one night with only idioms or only verbs. Players can choose to end the game after a predetermined number of rounds or after one player achieves a predetermined number of points.

In another exemplary method of play, play process as described in [0023] except there is no time limit at all. Builders build until other players guess the word or give up.

In another exemplary method of play, play proceeds as described in [0023] except players do not use word cards. Instead, players make up their own words. This method of play is great if cards are unavailable or if players wish to build words that are not represented on the cards.

In another exemplary embodiment, the entire game, including all the aforementioned exemplary embodiments and methods of play may be played digitally by virtue of an app on a tablet or mobile device or computer based software in any media including a video game and online game. Electronic components to the game play are contemplated by this disclosure such as an electronic timer. For example, the pieces that are used to build the visual representation of the word may be digital objects (e.g., displayed on a screen of a computing device, gaming device, or television) rather than physical objects.

In another exemplary embodiment, all the word card decks [0017], [0018], [0019], [0020], [0021], [0022] are translated and printed in other languages including but not limited to Spanish, French and German. Game-play adaptations for the visually and hearing impaired are included in this disclosure.

While the disclosure has been shown and described with reference to certain preferred embodiments thereof, it will be understood by those skilled in the art that various changes in form and detail may be made therein without departing from the scope and spirit of the disclosure.

As described above, embodiments can be in the form of processor-implemented processes and devices for practicing those processes, such as a processor. Embodiments can also be in the form of computer program code (e.g., computer program product) containing instructions embodied in tangible media (e.g., non-transitory computer readable medium), such as floppy diskettes, CD ROMs, hard drives, or any other non-transitory computer readable medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes a device for practicing the exemplary embodiments. When implemented on a general-purpose microprocessor, the computer program code segments configure the microprocessor to create specific logic circuits.

What is claimed is:

1. A method of playing a word-guess game with a game assembly, the method comprising:

playing a plurality of rounds in order to determine a winner of the word-guess game, wherein the completion of a predetermined amount of rounds of the plurality of rounds determines the winner of the word-guess game;

playing at least a first round of the word-guess game, the first round comprising the steps of:

obtaining, by a first player, a first word;

providing pieces to the first player, wherein each piece of the pieces are physical objects;

initiating a timer for a first time period;

building, by the first player after initiation of the timer for the first time period, a visual representation of the first word using the pieces while a second player observes the visual representation of the first word and attempts to identify the first word; and giving the first player and the second player a point if the second player correctly guesses the first word prior to expiration of the first time period, wherein the game assembly includes:

a deck of word cards, each of the word cards includes predetermined words related to a common defined theme including one or more of sports, entertainment, and age-range, wherein the first word is selected, by the first player, from one of the word cards;

the pieces, wherein each one of the pieces is formed as a shape including square, circle, stick, rectangle, triangle, oval, half-circle, half-oval, s-shape, V-shape, stick person, hand, foot, and arrow, wherein the pieces are arranged, by the first player, when building the visual representation of the first word; and the timer, including one or more of an hourglass, a stopwatch, an egg timer, and an electronic timing device, wherein the timer is initiated, for the first time period, for building, by the first player, the visual representation of the first word with the pieces; and a stand piece configured to support at least one piece of the pieces to change a plane in which the at least one piece is placed relative to another one of the pieces, whereby ones of the pieces in the building of the visual representation of the word are at different heights relative to each other.

2. The method of claim 1, wherein the one or more pieces of the word-guessing game includes:

a first set of pieces having a first color; and a second set of pieces having a second color.

3. The method of claim 1, wherein the pieces of the word-guessing game are configured to be slid across the playing surface to simulate movement.

4. The method of claim 1, wherein obtaining, by the first player, the first word further comprises:

providing one of the word cards to the first player, the word card having one or more words shown on the word card, wherein the one or more words include at least the first word.

5. The method of claim 4, wherein the first round further comprises:

selecting, by the first player, the first word from the one or more words shown on the word card.

6. The method of claim 1, wherein the first round further comprises:

obtaining, by a second player, a second word;

providing the pieces to the second player;

initiating the timer for a second time period;

building, by the second player after initiation of the timer for the second time period, a visual representation of the second word using the pieces while the first player observes the visual representation of the second word and attempts to identify the second word; and giving the first player and second player a point if the first player correctly guesses the second word prior to expiration of the second time period.

7. The method of claim 1, wherein the first round further comprises:

moving, by the first player after initiation of the timer, at least one of the pieces to create action and animate the visual representation of the first word while the second player observes the visual representation of the first word and attempts to identify the first word.

8. The method of claim 1, wherein the first round further comprises:

giving the first player and the second player an additional point if the second player correctly guesses the first word within a selected time period that is less than first time period.

9. The method of claim 1, wherein the first round further comprises:

removing one or more points from the first player and the second player if the second player fails to correctly guess the first word within the first time period.

10. The method of claim 1, wherein the first player and the second player are on a first team and compete against a second team composed of a third and a fourth player, wherein the first round further comprises:

obtaining, by a third player, a second word;

providing the pieces to the third player;

building, by the third player after initiation of the timer for the first time period, a visual representation of the second word using the pieces while the fourth player observes the visual representation of the second word and attempts to identify the second word; and giving the third player and the fourth player a point if the fourth player correctly guesses the second word prior to expiration of the first time period.

11. The method of claim 10, wherein the pieces are organized in a single group accessible by both the first player and the third player.

12. The method of claim 10, wherein the pieces are organized in a first set of pieces accessible by only the first player and a second set of pieces accessible by only the third player.

13. The method of claim 12, wherein the first set of pieces has a first color and the second set of pieces has a second color.

14. The method of claim 1, wherein the first player is not allowed to speak during the first time period.

15. The method of claim 1, wherein the first round further comprises:

providing, by the first player after initiation of the timer for the first time period, a category of the first word to the second player during the first time period.

* * * * *